US007984726B2

(12) United States Patent
Lin

(10) Patent No.: US 7,984,726 B2
(45) Date of Patent: Jul. 26, 2011

(54) PORTABLE SHELTER HAVING FRAME WITH PIVOTALLY COUPLED FOOT MEMBERS

(75) Inventor: Tseng Hsiang Lin, Taipei (TW)

(73) Assignee: YJIP, Inc., Addison, TX (US)

( * ) Notice: Subject to any disclaimer, the term of this patent is extended or adjusted under 35 U.S.C. 154(b) by 0 days.

(21) Appl. No.: 12/401,213

(22) Filed: Mar. 10, 2009

(65) Prior Publication Data

US 2010/0229905 A1 Sep. 16, 2010

(51) Int. Cl.
*E04H 15/48* (2006.01)
*E04H 15/62* (2006.01)

(52) U.S. Cl. ..... 135/143; 135/117; 135/118; 135/151; 248/156

(58) Field of Classification Search ..... 135/87, 135/121, 143–145, 148, 151, 117–118, 905; 248/156, 165; 52/292, 155, 159, 162, 164; 256/65.14; 473/478–479
See application file for complete search history.

(56) References Cited

U.S. PATENT DOCUMENTS 2,755,009 A 7/1956 Parker
3,105,505 A * 10/1963 Maybee ..... 135/135
3,854,254 A 12/1974 Janosko
4,779,635 A 10/1988 Lynch
4,885,877 A * 12/1989 Hunt et al. ..... 52/63
4,947,884 A 8/1990 Lynch
5,035,253 A 7/1991 Bortles
5,241,977 A * 9/1993 Flores et al. ..... 135/88.06
5,381,634 A * 1/1995 Pietrogrande et al. ..... 52/86
5,421,356 A 6/1995 Lynch
5,511,572 A 4/1996 Carter
5,632,293 A * 5/1997 Carter ..... 135/145
5,797,412 A 8/1998 Carter
5,820,494 A * 10/1998 Gates et al. ..... 473/421
5,921,260 A 7/1999 Carter
6,021,796 A 2/2000 Vavra
6,041,800 A 3/2000 Carter
6,076,312 A 6/2000 Carter
6,089,246 A * 7/2000 Barnes ..... 135/88.06
6,089,247 A * 7/2000 Price ..... 135/145
6,382,224 B1 5/2002 Carter
(Continued)

OTHER PUBLICATIONS

International Search Report dated May 4, 2010, International Application No. PCT/US2010/026773, International Filing Date Mar. 10, 2010.

(Continued)

*Primary Examiner* — Winnie Yip
(74) *Attorney, Agent, or Firm* — Harness Dickey & Pierce, P.L.C.

(57) ABSTRACT

A frame assembly for supporting an extendable wall member of a portable shelter on a foundation. The frame assembly includes a plurality of frame members that are operably secured together. The frame members are positionable between a first configuration, in which the wall member is extended, and a second configuration, in which the wall member is retracted. At least one frame member includes an end that is disposed adjacent the foundation. Furthermore, the frame assembly includes a foot member with a support portion. The foot member is pivotably coupled to the end of the frame member to pivot between a first position, in which the support portion is disposed between the end and the foundation to support the frame member on the foundation, and a second position, in which the support portion is disposed away from an area between the end and the foundation.

18 Claims, 2 Drawing Sheets

U.S. PATENT DOCUMENTS

| | | | | |
|---|---|---|---|---|
| 6,450,187 | B1 | 9/2002 | Lin et al. | |
| 6,470,902 | B1 | 10/2002 | Carter | |
| 6,502,593 | B1 * | 1/2003 | Stafford | 135/115 |
| 6,591,849 | B1 * | 7/2003 | Swetish et al. | 135/140 |
| 6,601,599 | B2 | 8/2003 | Carter | |
| 6,666,223 | B2 * | 12/2003 | Price et al. | 135/131 |
| 6,718,995 | B2 | 4/2004 | Dotterwelch | |
| 6,848,461 | B2 * | 2/2005 | Tsai | 135/131 |
| 6,874,520 | B2 | 4/2005 | Carter | |
| 7,178,539 | B2 | 2/2007 | Patel et al. | |
| 7,178,541 | B2 | 2/2007 | Carter | |
| 7,350,480 | B1 * | 4/2008 | Hughes | 119/512 |
| 7,363,933 | B2 | 4/2008 | Carter | |
| 7,681,848 | B2 * | 3/2010 | Choi | 248/188.8 |
| 2001/0025648 | A1 | 10/2001 | Carter | |
| 2003/0000563 | A1 | 1/2003 | Kuperman | |
| 2003/0029490 | A1 | 2/2003 | Price et al. | |
| 2004/0144413 | A1 | 7/2004 | Matthews et al. | |
| 2004/0261953 | A1 | 12/2004 | Hart | |
| 2005/0011134 | A1 | 1/2005 | Boltan et al. | |

OTHER PUBLICATIONS

Written Opinion dated May 4, 2010, International Application No. PCT/US2010/026773, International Filing Date Mar. 10, 2010.

Werner Aluminum D-Rung Extension Ladder: D1200-2 Series 225lb Rated Aluminum; www.industrialladder.com/productDetails.do?productID=2780&categoryID=40 (p. 20).

International Search Report dated May 12, 2010, International Application No. PCT/US10/026805, International Filing Date Mar. 10, 2010.

Written Opinion dated May 12, 2010, International Application No. PCT/US10/026805, International Filing Date Mar. 10, 2010.

International Search Report dated Jun. 21, 2010, International Application No. PCT/US10/27628, International Filing Date Mar. 17, 2010.

Written Opinion of the International Searching Authority dated Jun. 21, 2010, International Application No. PCT/US10/27628, International Filing Date Mar. 17, 2010.

* cited by examiner

PORTABLE SHELTER HAVING FRAME WITH PIVOTALLY COUPLED FOOT MEMBERS

FIELD

The present disclosure relates to a portable shelter and, more particularly, relates to a portable shelter having a frame with pivotally coupled foot members.

BACKGROUND

Portable shelters have been proposed for conveniently providing shade from the sun, for providing shelter from inclement weather, and the like. These shelters can be used as canopies for outdoor gatherings, as temporary awnings that extend from a recreational vehicle, and for other similar uses.

These shelters can include a self-supporting frame and a tarp, canvas, or other foldable roof/wall member that is coupled to and supported by the frame. The frame can be expanded to unfold, unfurl, or otherwise extend the roof/wall member such that the roof/wall member provides shelter. The frame can also be retracted to fold or otherwise retract the roof/wall member and to make the shelter more compact and portable.

The frames of these shelters can be very easy moved between the expanded and retracted positions. Also, these shelters can be made of relatively lightweight materials to enhance portability and to further enable movement of the frame between the expanded and retracted positions.

Although conventional portable shelters have been adequate for the intended purposes, they do suffer from certain disadvantages. For instance, the shelter may not be sufficiently supported on the ground. More specifically, if the ground surface is uneven, the frame may not contact the ground evenly, and the shelter may not remain stationary as a result. Furthermore, if the shelter is subjected to strong gusts of wind, the shelter may blow over because it is not adequately secured to the ground.

SUMMARY

Accordingly, despite the improvements of known devices described above, there remains a need for a frame assembly for supporting an extendable wall member of a portable shelter on a foundation. The frame assembly includes a plurality of frame members that are operably secured together. The frame members are positionable between a first configuration, in which the wall member is extended, and a second configuration, in which the wall member is retracted. At least one frame member includes an end that is disposed adjacent the foundation. Furthermore, the frame assembly includes a foot member with a support portion. The foot member is pivotably coupled to the end of the frame member to pivot between a first position, in which the support portion is disposed between the end and the foundation to support the frame member on the foundation, and a second position, in which the support portion is disposed away from an area between the end and the foundation.

In another aspect, a portable shelter is disposed that is supportable on a foundation. The portable shelter includes an extendable wall member and a frame assembly for supporting the wall member. The frame assembly includes a plurality of frame members that are operably secured together. The frame members are positionable between a first configuration, in which the wall member is extended, and a second configuration, in which the wall member is retracted. At least one frame member includes an end that is disposed adjacent the foundation. Furthermore, the frame assembly includes a foot member with a support portion. The foot member is pivotably coupled to the end of the frame member to pivot between a first position, in which the support portion is disposed between the end and the foundation to support the frame member on the foundation, and a second position, in which the support portion is disposed away from an area between the end and the foundation.

In still another aspect, a portable shelter that is supportable on a foundation is disclosed. The portable shelter includes a foldable sheet of material that provides shelter and a frame assembly for supporting the sheet. The frame assembly includes a plurality of elongate frame members that are movably secured together. The frame members are positionable between a first configuration, in which the sheet is extended, and a second configuration, in which the sheet is folded. Each of the elongate frame members include an end that is disposed adjacent the foundation. Furthermore, the frame assembly includes a plurality of foot members each pivotably coupled to respective ends of the frame members. Each foot member includes a support portion and a staking portion. Also, each foot member is pivotable relative to the respective frame member between a first position, in which the respective support portion is disposed between the respective end and the foundation to support the respective frame member on the foundation, and a second position, in which the respective support portion is disposed away from an area between the respective end and the foundation. The respective staking portion is oriented toward the foundation to extend into the foundation to secure the respective frame member to the foundation when in the second position.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
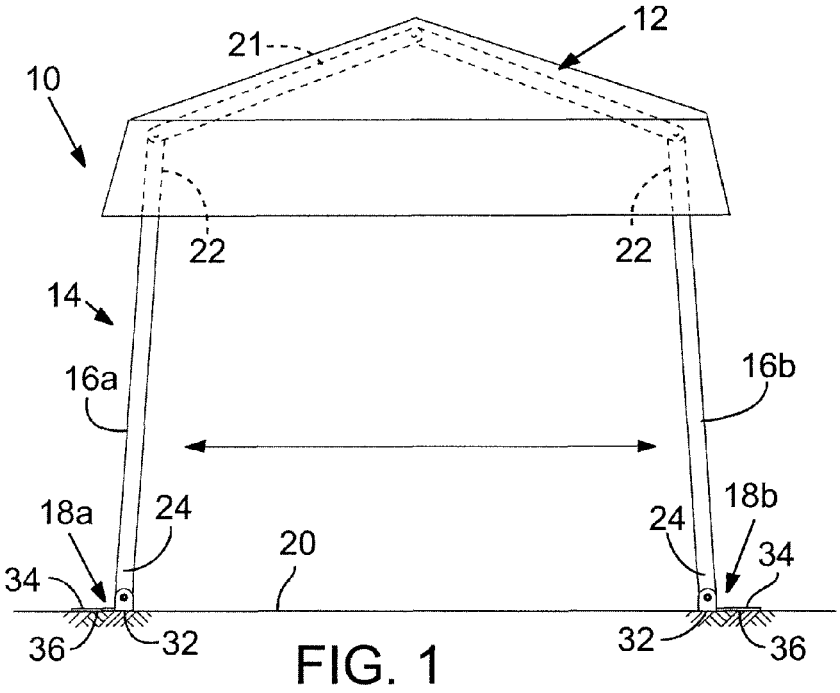
FIG. 1 is a side view of an exemplary embodiment of a portable shelter according to various teachings of the present disclosure, the portable shelter shown in a first configuration.

Referring initially to FIG. 1, a portable structure 10 is illustrated according to various embodiments of the present disclosure. Generally, the portable structure 10 includes an extendable wall member 12 and a frame assembly 14. The frame assembly 14 generally includes a plurality of frame members 16*a*, 16*b* and a plurality of foot members 18*a*, 18*b*. The frame assembly 14 operably supports the wall member 12 on a foundation 20, such as asphalt, grass, dirt, or any other suitable surface.

Figure 2:
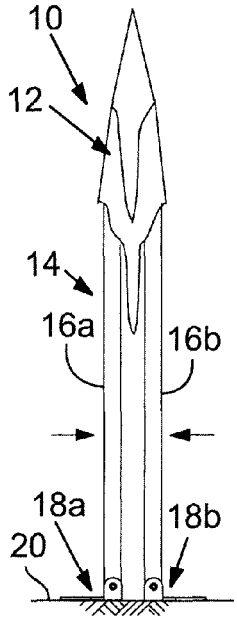
FIG. 2 is a side view of the portable shelter of FIG. 1 shown in a second configuration.

Also, as shown in FIGS. 1 and 2, the frame assembly 14 is positionable between a first configuration (FIG. 1) and a second configuration (FIG. 2). In the first configuration, the frame members 16*a*, 16*b* are spaced apart from each other such that the portable structure 10 is self-supporting and standing on the foundation 20 and the wall member 12 is extended (i.e., deployed, expanded, etc.). Also, in the second configuration, the frame members 16*a*, 16*b* are disposed generally adjacent each other such that the portable structure 10 is retracted (i.e., collapsed, made portable, etc.), and the wall member 12 is retracted (i.e., folded, stowed, etc.). Movement of the frame assembly 14 between the first and second configurations will be discussed in greater detail below. Accordingly, the portable structure 10 can be quickly and conveniently moved to the first configuration (FIG. 1) to provide shelter from the sun, rain, or other elements, and the portable structure 10 can also be quickly and conveniently moved to the second configuration (FIG. 2) such that the portable structure 10 can be easily transported and/or stowed.

The wall member 12 can include one or more foldable sheets of polymeric material, canvas, or any other suitable material. The sheets of the wall member 12 can be stitched, adhered, or otherwise operably secured together. The wall member 12 can be foldable to allow the portable structure 10 to remain secured to the frame assembly 14 and yet move between the first configuration (FIG. 1) and the second configuration (FIG. 2). In the embodiment shown in FIG. 1, the wall member 12 can cover an upper area of the portable structure 10 so as to operate as a roof or canopy covering; however, it would be appreciated that the wall member 12 could be in any other suitable arrangement. For instance, the wall member 12 can also include enlarged vertical side panels (not shown) for enclosing larger vertical areas of the portable structure 10. Furthermore, the wall member 12 can be configured to substantially enclose an area between the frame members 16*a*, 16*b*.

Moreover, the frame members 16*a*, 16*b* can be elongate poles that each includes a first end 22 and a second end 24. The frame members 16*a*, 16*b* are supported generally upright so that the second end 24 is disposed adjacent the foundation 20 and the first end 22 is spaced upward from the foundation 20. The frame member 16*a*, 16*b* can be hollow, and the frame member 16*a*, 16*b* can have a rectangular, square, circular, or any other suitable cross-sectional shape. Additionally, the frame member 16*a*, 16*b* can be made out of a relatively lightweight material, such as aluminum or any other suitable material. Although only two frame members 16*a*, 16*b* are shown in FIGS. 1 and 2, it will be appreciated that the portable structure 10 can include any suitable number of frame members 16*a*, 16*b*. For instance, the frame assembly 14 can include four frame members 16*a*, 16*b* extending upright from the foundation 20 and arranged at respective corners of the portable structure 10.

The frame assembly 14 can also include rafter frame members (shown in phantom in FIG. 1 and indicated generally at 21). The rafter frame members 21 can be interconnected and operatively secured to the respective first ends 22 of the frame members 16*a*, 16*b*. Also, the rafter frame members 21 can be moveably interconnected (e.g., pivotably or hingeably interconnected) and movably coupled (e.g., pivotably or hingeably coupled) to the frame members 16*a*, 16*b*. Accordingly, the rafter frame members 21 moveably couple the frame members 16*a*, 16*b*, and the rafter frame members 21 move relative to each other when the frame assembly 14 moves between the first configuration (FIG. 1) and the second configuration (FIG. 2). The wall member 12 extends about and between the first ends 22 of the frame member 16*a*, 16*b* and over the rafter frame members 21.

Accordingly, to move the frame assembly 14 from the first configuration (FIG. 1) to the second configuration (FIG. 2), the frame member 16*a*, 16*b* can be moved toward each other, thereby causing the rafter frame members 21 to pivot relative to each other and causing the wall member 12 to fold. Accordingly, the structure 10 becomes more compact and can be more easily transported and/or stowed. Also, to move the frame assembly 14 from the second configuration (FIG. 2) to the first configuration (FIG. 1), the frame member 16*a*, 16*b* can be moved apart from each other, thereby causing the rafter frame members 21 to pivot relative to each other and to unfold, deploy, or generally extend the wall member 12. Accordingly, the structure 10 can be easily deployed to provide shelter from the sun, rain, or other elements.

Now referring to FIGS. 1-5, the foot members 18*a*, 18*b* will be discussed in greater detail. For purposes of discussion, the foot member 18*a* will be discussed in detail; however, it will be appreciated that the foot member 18*b* can have substantially identical features as the foot member 18*a*.

Figure 3:
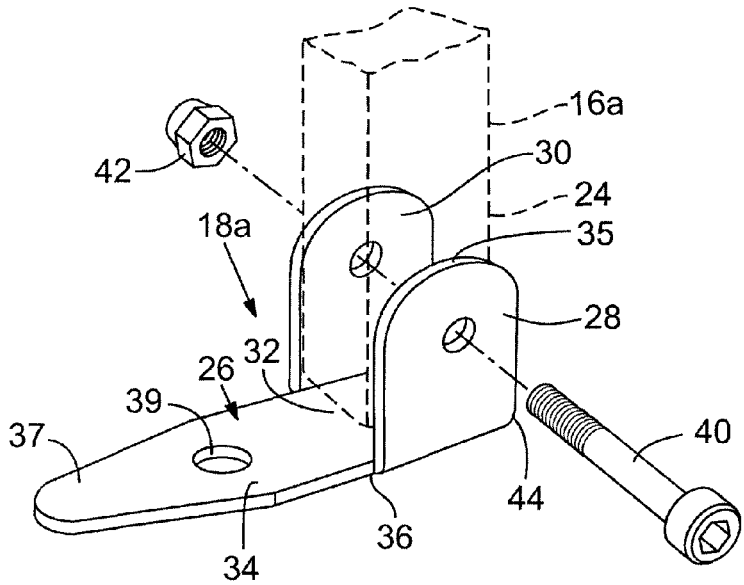
FIG. 3 is an exploded perspective view of an end of an exemplary embodiment of a foot member of the portable shelter of FIG. 1, the foot member shown in a first position.
Figure 5:
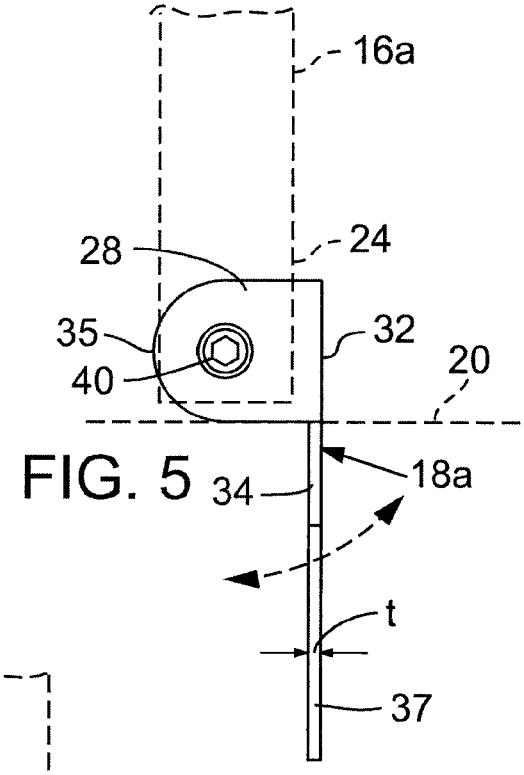
FIG. 5 is a side view of the foot member of FIG. 3 shown in a staked position.

As shown in FIG. 3, the foot member 18*a* can be made out of a bent sheet of rigid material, such as metal. For instance, the foot member 18*a* can be made out of steel, aluminum, etc. However, the foot member 18*a* can be made out of any suitable material and can be formed in any suitable fashion. More specifically, the foot member 18*a* can be bent so as to define a main body 26, a first flange 28, and a second flange 30. As such, the main body 26, the first flange 28, and the second flange 30 can be integrally coupled so as to be monolithic. Also, the main body 26 and the flanges 28, 30 can have approximately thicknesses t (FIG. 5).

As shown in FIG. 3, the main body 26 can include a support portion 32 and a staking portion 34, which are integrally coupled so as to be monolithic. The support portion 32 and the staking portion 34 cooperate to define a support surface 36, which supports the structure 10, as will be described in greater detail below. The flanges 28, 30 extend from opposite edges of the support portion 32. The flanges 28, 30 can be substantially perpendicular to the support portion 32. Also, the flanges 28, 30 can include respective rounded top edges 35. Moreover, the staking portion 34 can extend transversely away from the flanges 28, 30 and away from the support portion 32 in a single direction.

The second end 24 of the respective frame member 16*a* can be disposed between the support portion 32, the first flange 28, and the second flange 30, and the foot member 18*a* can be pivotably coupled to the end 24. The foot member 18*a* can be pivotably coupled to the end 24 in any suitable fashion. For instance, the portable structure 10 can include a fastener 40, and a nut 42 (FIG. 3) for pivotably coupling the foot member 18*a* to the end 24 of the frame member 16*a*. The fastener 40 can be a bolt that extends through the first flange 28, the frame member 16*a*, and the second flange 30, and the nut 42 can threadably couple to the fastener 40 to secure the foot member 18*a* to the end 24. It will be appreciated that the portable structure 10 could also include bearings or any other suitable means of pivotably coupling the foot member 18*a*. Also, in some embodiments, the foot member 18*a* is freely rotatable relative to the frame member 16*a*; however, the structure 10 could include a retaining mechanism for locking the foot member 18*a* against rotation relative to the frame member 16*a*. Moreover, the fastener 40 can couple the foot member 18*a* to the frame member 16*a* such that the foot member 18*a* frictionally rotates relative to the frame member 16*a* and such that the foot member 18*a* rotates against significant friction relative to the frame member 16*a*. Moreover, the portable structure 10 could include a biasing member, such as a torsion spring for rotatably biasing the foot member 18*a* toward a position relative to the frame member 16*a*.

Moreover, as shown in FIG. 1, the foot members 18*a*, 18*b* are coupled to the respective frame member 16*a*, 16*b* such that the respective staking portions 34 extend away from each other. As such, the footprint of the portable structure 10 can be wider for increased and improved support. However, the foot members 18*a*, 18*b* can be coupled to the respective frame members 16*a*, 16*b* such that the respective staking portions 34 extend toward each other without departing from the scope of the present disclosure.

Figure 4:
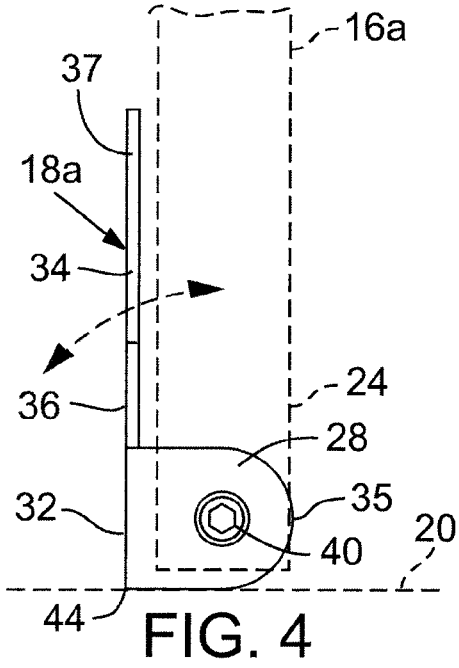
FIG. 4 is a side view of the foot member of FIG. 3 shown in a stowed position.

As shown in FIGS. 1, 2, 4, and 5, the foot members 18*a*, 18*b* can pivot between a first position (FIGS. 1 and 2) and a second position (FIGS. 4 and 5). In the first position, the support portion 32 is disposed between the respective end 24 of the frame member 16*a*, 16*b* and the foundation 20 to support the frame member 16*a*, 16*b* on the foundation 20. In the second position, the support portion 32 is disposed away from an area between the respective end 24 and the foundation 20, as will be described in greater detail below.

More specifically, as shown in FIGS. 1 and 2, when the foot member 18*a*, 18*b* is disposed in the first position, the support surface 36 is disposed directly atop the foundation 20 to support the respective frame member 16*a*, 16*b* on the foundation 20 in a generally upright position. Accordingly, because of the enlarged support surface 36, the foot member 18*a*, 18*b* provides a significant amount of support for the portable structure 10. Moreover, the foot member 18*a*, 18*b* can pivot to maintain sufficient contact with the foundation 20, even if the foundation 20 varies in height for improved support. Furthermore, the through-hole 39 (FIG. 3) in the staking portion 34 provides access to the foundation 20 through the foot member 18*a*, 18*b* to further secure the portable structure 10. For instance, a rod, stake, or other suitable means can be driven into the foundation 20 through the through-hole 39 to anchor the portable structure 10 to the foundation 20 via the foot member 18*a*, 18*b*.

In addition, in the second position of the foot member 18*a* shown in FIG. 4, the foot member 18*a* is rotated toward the frame member 16*a* such that the staking portion 34 is generally parallel and adjacent the frame member 16*a*. As such, the foot member 18*a* is stowed to make the structure 10 more compact. As such, the foot member 18*a* can be moved to this position when transporting and/or stowing the portable structure 10. Moreover, the foot member 18*a* can be rotated to the position shown in FIG. 4 to support the frame member 16*a* in a generally upright position on the foundation 20. For these purposes, the foot member 18*a* defines an edge 44 that is continuous from the first flange 28, the support portion 32, and the second flange 30. The edge 44 can be disposed directly atop the foundation 20 for providing significant support for the portable structure 10. Also, in some embodiments, the foot member 18*a* can rotate sufficiently enough to allow the end 24 of the frame member 16*a* to directly contact the foundation 20 when the foot member 18*a* is moved to the second position.

Furthermore, when the foot member 18*a* is rotated to the second position shown in FIG. 5, the staking portion 34 can be oriented generally parallel to the frame member 16*a* and away from the frame member 16*a*. As such, the staking portion 34 can be oriented toward the foundation 20 to extend into the foundation 20 to secure the frame member 16*a* to the foundation 20. Accordingly, the foot member 18*a* can be staked into the foundation 20 to firmly secure the frame member 16*a* to the foundation 20.

Figure 6:
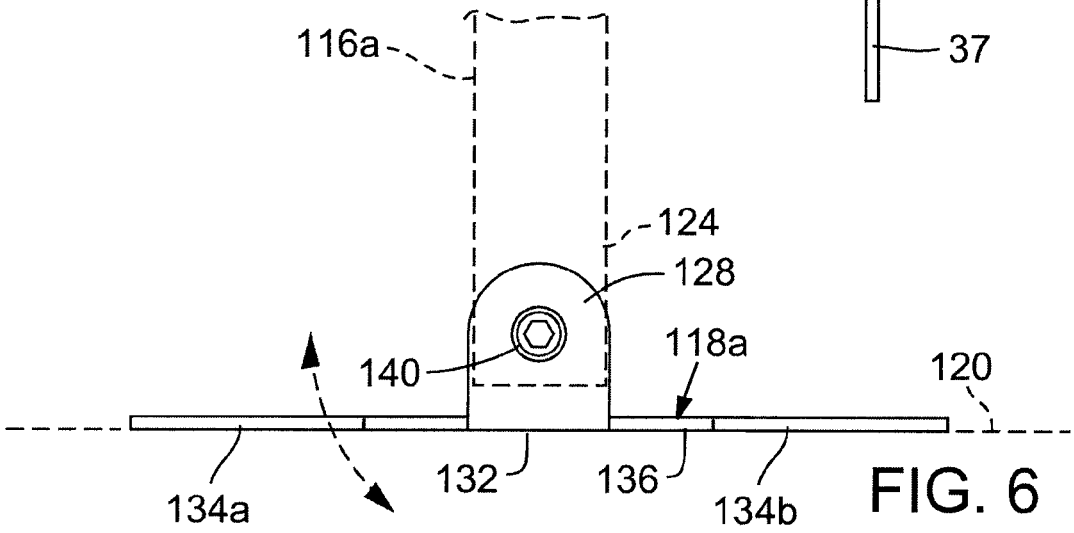
FIG. 6 is a side view of another exemplary embodiment of the foot member.

Referring now to FIG. 6, another embodiment of the foot member 118*a* is illustrated. Components that are similar to the embodiments of FIGS. 1-5 are indicated with corresponding reference numerals increased by 100.

As shown, the foot member 118*a* can include a first staking portion 134*a* and a second staking portion 134*b* extending in opposite directions from the support portion 132. Accordingly, the staking portions 134*a*, 134*b* and the support portion 132 cooperate to define a relatively large support surface 136 for supporting the portable structure 10. Also, either staking portion 134*a*, 134*b* can extend into the foundation 120 when the foot member 118*a* is moved to the second position as discussed above.

In summary, the foot members 18*a*, 18*b*, 118*a* provide significant support for the portable structure 10 such that the portable structure 10 is unlikely to inadvertently move, blow over, etc. Furthermore, because the foot members 18*a*, 18*b*, 118*a* are pivotably coupled, the foot members 18*a*, 18*b*, 118*a* can maintain sufficient contact on the foundation 20 even if the foundation 20 varies in height.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A frame assembly for supporting an extendable wall member of a portable shelter on a foundation, the frame assembly comprising:

a plurality of frame members that are operably secured together, the frame members positionable between a first configuration, in which the wall member is extended, and a second configuration, in which the wall member is retracted, at least one frame member including an end adapted to be disposed adjacent the foundation; and a foot member including a support portion and a staking portion, the foot member being pivotably coupled to the end of the at least one frame member to pivot between a retracted position in which the staking portion is oriented upward and the support portion is disposed away from the end of the at least one frame member, and the support member does not operably engage the foundation when the end of the at least one frame member is positioned adjacent to the foundation, a first position, in which the support portion is disposed below the end in an area between the end and the foundation to support the at least one frame member on the foundation, and a second position, in which the support portion is disposed away from the area between the end and the foundation and the staking portion is oriented downward for extending into the foundation and securing the at least one frame member to the foundation.

2. The frame assembly of claim 1, wherein the staking portion includes a tapered end.

3. The frame assembly of claim 1, wherein the staking portion and the support portion cooperate to define a support surface that is disposed directly atop the foundation to support the at least one frame member on the foundation when the foot member is in the first position.

4. The frame assembly of claim 3, wherein the support portion and the staking portion are integrally coupled so as to be monolithic.

5. The frame assembly of claim 1, wherein the foot member further includes a first flange and a second flange that are coupled to the end of the at least one frame member, the end being disposed between the first flange, the support portion, and the second flange in the first position.

6. The frame assembly of claim 5, further comprising a fastener that extends through the first flange, the at least one frame member, and the second flange to pivotably couple the foot member to the at least one frame member.

7. The frame assembly of claim 1, wherein the support portion includes an edge that is disposed directly atop the foundation when the foot member is in the second position.

8. The frame assembly of claim 1, wherein the foot member includes a through hole that provides access to the foundation through the foot member.

9. The frame assembly of claim 1, wherein the foot member includes a staking portion, a first flange, and a second flange each integrally coupled to the support portion so as to be monolithic, wherein the support portion, the staking portion, the first flange, and the second flange each have an approximately equal thickness.

10. A portable shelter that is supportable on a foundation comprising:

an extendable wall member; and a frame assembly for supporting the wall member, the frame assembly including:

a plurality of frame members that are operably secured together, the frame members positionable between a first configuration, in which the wall member is extended, and a second configuration, in which the wall member is retracted, at least one frame member including an end adapted to be disposed adjacent the foundation; and a foot member including a support portion and a staking portion, the foot member being pivotably coupled to the end of the at least one frame member to pivot between a retracted position in which the staking portion is oriented upward and the support portion is disposed away from the end of the at least one frame member, and the support member does not operably engage the foundation when the end of the at least one frame member is positioned adjacent to the foundation, a first position, in which the support portion is disposed between below the end in an area the end and the foundation to support the at least one frame member on the foundation, and a second position, in which the support portion is disposed away from the area between the end and the foundation and the staking portion is oriented downward for extending into the foundation and securing the at least one frame member to the foundation.

11. The portable shelter of claim 10, wherein the staking portion includes a tapered end.

12. The portable shelter of claim 10, wherein the staking portion and the support portion cooperate to define a support surface that is disposed directly atop the foundation to support the at least one frame member on the foundation when the foot member is in the first position.

13. The portable shelter of claim 12, wherein the support portion and the staking portion are integrally coupled so as to be monolithic.

14. The portable shelter of claim 10, wherein the foot member further includes a first flange and a second flange that are coupled to the end of the at least one frame member, the end being disposed between the first flange, the support portion, and the second flange in the first position.

15. The portable shelter of claim 10, wherein the support portion includes an edge that is disposed directly atop the foundation when the foot member is in the second position.

16. The portable shelter of claim 10, wherein extendable wall member includes a foldable sheet that is folded when the plurality of frame members are in the second configuration.

17. The portable shelter of claim 10, wherein the plurality of frame members that are moveably secured together.

18. A portable shelter that is supportable on a foundation comprising:

a foldable sheet of material that provides shelter; and a frame assembly for supporting the sheet, the frame assembly including:

a plurality of elongate frame members that are movably secured together, the frame members positionable between a first configuration, in which the sheet is extended, and a second configuration, in which the sheet is folded, each of the elongate frame members including an end that is disposed adjacent the foundation; and a plurality of foot members each pivotably coupled to respective ones of the ends of the frame members, each foot member including a support portion and a staking portion, each foot member pivotable relative to the respective frame member between a retracted position in which the respective staking portion is oriented upward and the respective support portion is disposed away from the end of the at least one frame member, and the support member does not operably engage the foundation when the end of the at least one frame member is positioned adjacent to the foundation, a first position, in which the respective support portion is disposed below the end in an area between the respective end and the foundation to support the respective frame member on the foundation, and a second position, in which the respective support portion is disposed away from the area between the respective end and the foundation, the respective staking portion being oriented toward the foundation to extend into the foundation to secure the respective frame member to the foundation when in the second position.

* * * * *